US006530094B1

(12) United States Patent
Neo

(10) Patent No.: US 6,530,094 B1
(45) Date of Patent: Mar. 11, 2003

(54) DISPENSER AND METHOD AND VALVE

(75) Inventor: Boon Lye Paul Neo, Jalan Rindu (SG)

(73) Assignee: Calfarme Pte. Ltd., Singapore (SG)

( * ) Notice: Subject to any disclaimer, the term of this patent is extended or adjusted under 35 U.S.C. 154(b) by 0 days.

(21) Appl. No.: 09/319,884

(22) PCT Filed: Dec. 13, 1997

(86) PCT No.: PCT/SG97/00070

§ 371 (c)(1),
(2), (4) Date: Aug. 2, 1999

(87) PCT Pub. No.: WO98/27288

PCT Pub. Date: Jun. 25, 1998

Related U.S. Application Data

(60) Provisional application No. 60/053,193, filed on Jul. 21, 1997.

(30) Foreign Application Priority Data

Dec. 14, 1999 (SG) ..... 9611883

(51) Int. Cl.[7] ..... E03D 9/02

(52) U.S. Cl. ..... 4/226.1; 137/205.5; 137/210; 222/185.1

(58) Field of Search ..... 4/222, 224, 226.1; 222/185.1; 137/205.5, 210

(56) References Cited

U.S. PATENT DOCUMENTS 1,447,289 A * 3/1923 Farnham ..... 4/226.1
3,002,197 A * 10/1961 Tillman ..... 4/226.1
3,964,108 A * 6/1976 Lissau ..... 4/226.1
5,377,363 A * 1/1995 Shieh ..... 4/226.1

FOREIGN PATENT DOCUMENTS

| | | | |
|---|---|---|---|
| AU | 115 738 | * | 8/1942 |
| AU | B-575 896 | * | 7/1985 |
| CH | 371 403 | * | 9/1963 |
| DE | 2 100 795 | * | 7/1972 |
| DE | 94 11 912 | * | 11/1994 |
| GB | A-692 495 | * | 6/1953 |
| GB | 1 462 201 | * | 1/1977 |
| GB | 2319456 B1 | * | 5/1998 |
| WO | 83 01974 | * | 6/1983 |

* cited by examiner

*Primary Examiner*—Charles R. Eloshway
(74) *Attorney, Agent, or Firm*—Welsh & Katz, Ltd.

(57) ABSTRACT

A flowable material dispensing system is disclosed which includes a container (5) for holding the flowable material, the container (5) having a downwardly directed lower outlet opening (510) which can be located within an outer container being either a cistern of a flushing system or within a cabinet (40,41) that is connectable to a flushing flow path of sanitation apparatus, the container (5) being so located that a portion of flowable material within said container (5) is discharged therefrom during each flushing operation of the sanitation system.

24 Claims, 8 Drawing Sheets

DISPENSER AND METHOD AND VALVE

This application claims the benefit of provisional application No. 60/053,193, filed Jul. 21, 1997.

This invention relates to an apparatus for dispensing and a method for dispensing flowable materials particularly, but not exclusively, into sanitation systems in bathrooms, toilets and the like. The invention further relates to a valve mechanism for use in a flowable material dispensing apparatus.

As water flows through a sanitation system, it is desirable to add to the water an amount of material, such as disinfectants, detergents, deodorants, cleaning agents or the like.

In the prior art, an amount of water from the sanitation system is diverted into a container which contains the sanitation material. The water mixes with the sanitation material and a portion of the diluted sanitation material returns to the main sanitation system.

In other known apparatus, such as in International Application No. PCT/GB82/00341 (Lotti), a quantity of sanitation material is dispensed into the water. The problem with this earlier art is that the apparatus required to dispense the sanitation material into the water is complex in shape.

United Kingdom Patent 1,462,201 (Braun Company) discloses a liquid dispensing valves, but this known valve is adapted to dispense material in response to steadily rising liquid in a reservoir. The Braun patent is not adapted to being incorporated in other areas of sanitation systems in which there is no reservoir of liquid that rises steadily. For instance, this dispenser would not be suitable for attachment to regions in the sanitation system that experience current flows, since the Braun patent relies on liquid rising steadily up into the valve, and is not adapted to function with liquid that rushes past the valve. Thus, it is not suitable for connection in locations in sanitation systems where turbulent or running liquid is found, such as in down-pipes.

Australian patent application AU-A-37302/85 in the name of 3C Chemical Laboratories Pty. Ltd. discloses an embodiment of a dispenser that is suitable for attachment to regions of a sanitation system that experience turbulent flow. However, a problem with this known dispenser is that it functions only when it is exposed to sufficient liquid flow, and does not appear to work as well when there is no liquid current flowing. Instead, the approach taken in this patent application, when there is insufficient liquid current flow, is to provide the dispenser with a cap that extends downwards. The downwardly extending cap extends into the liquid, and relies on the liquid level to rise in order for the dispenser to work. Thus, the use of the cap causes the dispenser to function in a similar manner to the Braun patent mentioned above. Thus, when faced with situations of insufficient liquid reaching the dispenser, the approach in this patent application is to revert to a similar mechanism used in the Braun patent. Thus, it has the problem that it must be attached to the sanitation system in such a manner that liquid can reach the dispenser, and this limits the location at which this dispenser can and cannot be attached in relation to the overall configuration of the sanitation system.

SUMMARY OF INVENTION

According to an aspect of the invention, there is provided a flowable material dispensing apparatus for dispensing flowable material into a sanitation system, said apparatus comprising:

a first container having inlet means to receive a flow of current from the sanitation system directed to said first container and having outlet means to permit flow of the flowable material out of said first container, wherein the dispensing apparatus is provided with a restricted flow passage for connecting the sanitation system to the inlet means of the first container, the restricted flow passage being restricted to such an extent that the passage is capable of directing the following to the inlet means of the first container:

i) directing an air current originating from the sanitation system;

the dispensing apparatus also being provided with a second container located within said first container, said second container being adapted to hold a quantity of said flowable material and having at least one restricted flow outlet opening facing in a downward direction, the or each said restricted flow outlet opening being configured to prevent flow of the flowable material in a downward direction when the flowable material at the or each said restricted flow outlet opening is not exposed to the air current in said first container and allowing flow of the flowable material downwardly through the or each said restricted flow outlet opening when the flowable material at the or each said restricted flow opening is exposed to the air current in said first container.

According to another aspect of the invention, there is provided a flowable material dispensing apparatus for dispensing flowable material into a sanitation system, said apparatus comprising:

a first container having inlet means to receive a flow of current from the sanitation system directed to said first container and having outlet means to permit flow of the flowable material out of said first container, wherein the dispensing apparatus is provided with a restricted flow passage for connecting the sanitation system to the inlet means of the first container, the restricted flow passage being restricted to such an extent that the passage is capable of directing the following to the inlet means of the first container:

i) directing an air current originating from the sanitation system;

the dispensing apparatus also being provided with a second container located within said first container, said second container being adapted to hold a quantity of said flowable material and having at least one restricted flow outlet opening facing in a downward direction, the or each said restricted flow outlet opening being configured to prevent flow of the flowable material in a downward direction when the flowable material is in an equilibrium state, and flow generation means to provide the air current condition at the or each said restricted flow outlet opening whereby a localised area of low pressure is formed to assist flow of the flowable material through the or each said restricted flow outlet opening.

The flow generation means may be able to provide all of the following at the or each said restricted flow outlet opening:

the air current condition;

a liquid current condition; or a current condition consisting of both air and liquid.

The restricted flow passage may be restricted to such an extent that the passage is capable of directing all of the following to the inlet means of the first container:

i) directing an air current originating from the sanitation system;

ii) directing a liquid current originating from the sanitation system; or iii) directing a current consisting of both air and liquid originating from the sanitation system.

Preferably, the at least one restricted flow outlet opening of the second container permits flow of the flowable material in response to the air and/or liquid current condition adjacent the at least one restricted flow outlet, and the at least one restricted flow outlet opening of the second container preventing flow of the flowable material in the absence of the air and/or liquid current condition adjacent the at least one restricted outlet opening.

The first container may be formed by a liquid holding receptacle of a sanitation flushing system, and the liquid received into said liquid holding receptacle may be used as flushing liquid.

The first container and said second container may form a sub assembly and said inlet means to said first container may be adapted for connection to a liquid flow path in a sanitation flushing system whereby air and/or liquid in said flow path can flow into said first container.

The inlet means may separate to said outlet means. Alternatively, the inlet means and said outlet means may be formed by a common flow passage.

An air and/or liquid current generation means may be provided for creating the air and/or the liquid current into said first container, the current generation means may be formed by the restricted flow passage to allow said air and/or liquid to flow immediately adjacent the or each said restricted flow opening.

A localised area of low pressure may be formed adjacent an external face of the or each said restricted flow opening whereby flow of said flowable material toward said localised low pressure area is assisted.

According to a further aspect of the invention, there is provided a method of dispensing a quantity of flowable material from a container into a sanitation system, said method comprising the steps of:

placing flowable material in a container which is provided with at least one generally downwardly directed opening for said flowable material to exit from said container such that, in an equilibrium state, said material in said container remains substantially within said container; and creating an air current adjacent the or each said opening such that a quantity of the flowable material is extracted from said container through the or each said opening in response to said current, such that said quantity of material is able to be conveyed by said liquid to said sanitation system.

The method may include using a restricted flow passage to connect the container and the sanitation system, and restricting the flow passage to such an extent that the passage is capable of directing all of the following adjacent the or each said opening of the container:

i) an air current originating from the sanitation system;

ii) a liquid current originating from the sanitation system, or iii) a current consisting of both air and liquid originating from the sanitation system.

According to yet a further aspect of the invention, there is provided a valve which is adapted for use in a sanitation material dispensing apparatus which is connectable to a sanitation system, said valve being provided with an internal duct therethrough, a cross-section of said duct being alterable by an aperture-varying mechanism, wherein adjustment of said mechanism controls the amount of liquid that enters said dispensing apparatus through said valve.

DRAWINGS

In order that the invention might be more fully understood, embodiments of the invention will be described, by way of example only, with reference to the accompanying drawings, in which:

FIG. 3A shows the apparatus configuration as air and/or liquid is diverted in from the sanitation system, and FIG. 3B shows the configuration as the air and/or liquid drains away from the apparatus.

EMBODIMENTS

Figure 1:
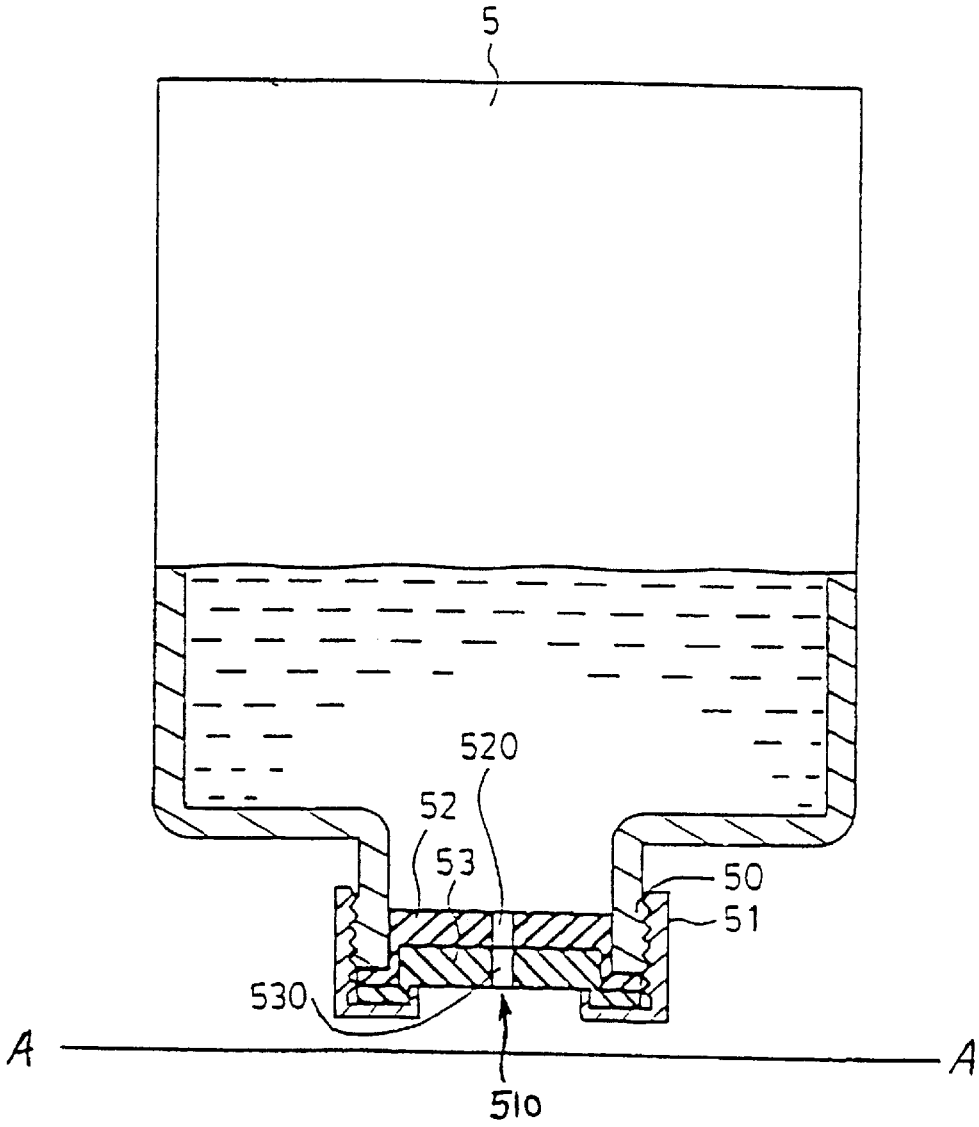
FIG. 1 is a cross-sectional diagram of a sanitation liquid dispensing apparatus constructed according to an embodiment of the invention, shown with the apparatus positioned above the waterline A—A of a sanitation system.

Referring to the drawings, FIG. 1 illustrates a dispensing device for use with a sanitation system, the device comprising a container 5. The lower portion of the drawing shows a partial cross-sectional view.

The container 5 is used in a sanitation system which, in the present preferred embodiment, is a toilet flushing system. In the present embodiment, the container is placed in direct fluid communication with the main duct from the cistern to the toilet. The container 5 may be filled with a flowable material which may be disinfectant, detergent, deodorant or other materials used for sanitation systems. The flowable material within the container 5 would usually be a liquid, but other flowable materials such as gels may also be used. When the sanitation system is in use, the water within the cistern flushes to a toilet. A portion of the water is diverted to the opening of the container where it is believed to break the film of surface tension covering the opening. A small amount of sanitising material then discharges into the diverted water because of the hydrostatic pressure of the flowable material within the container. Turbulence and diffusion assist in mixing the sanitising material with the diverted water which then drains back into the main duct from the cistern and into the toilet where it acts to clean, disinfect and/or deodorise, depending on the characteristics of the flowable material.

Once the diverted water and sanitising material have drained away from the opening, the surface tension film soon reforms to substantially prevent any further discharge of sanitising material until next the sanitation system is in use.

The container 5 has preferably been provided with a downwardly directed opening 510 preferably located at its lowest point as this is the point of greatest hydrostatic pressure within the container 5. Therefore, the discharge of flowable material will be greatest at this point. During installation of the container 5, there is an initial flow of liquid through the opening 510. Some air may also remain in the container 5. After a short period of time, an equilibrium state is reached where the flow of liquid ceases. This cessation of flow is a result of surface tension across the opening 510.

Breaking the surface tension may be effected by bringing a fluid into contact with the opening 510. The fluid may be a stationary liquid, or air and/or liquid in steady state or turbulent flow.

Figure 2:
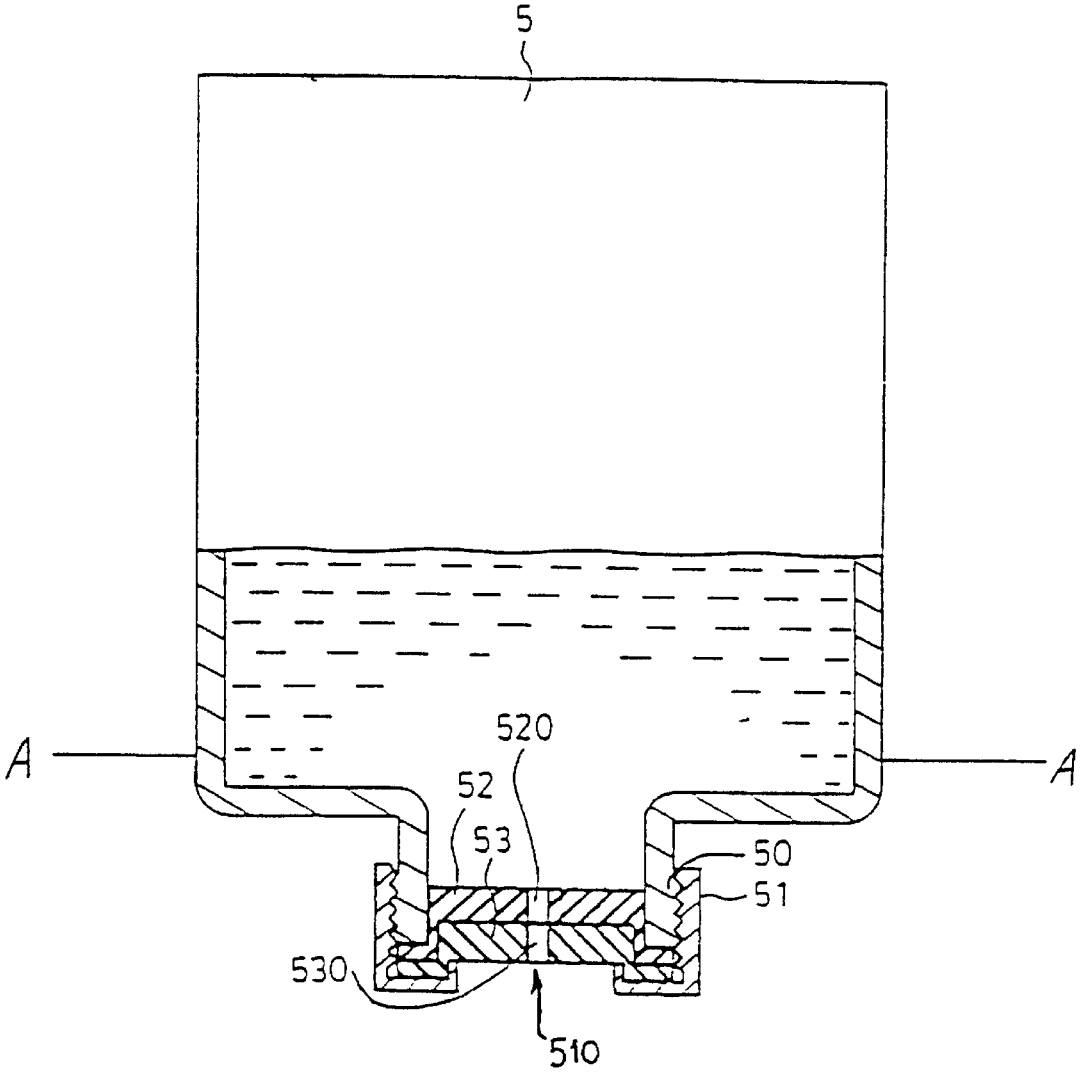
FIG. 2 illustrates an embodiment of the invention positioned partially below the waterline A—A of the sanitation system.

With regard to the preferred embodiment shown in FIG. 2, the container 5 is placed within a cistern (not shown) such that the opening 510 is below the surface of the water A—A of the cistem. The contact of the water with the opening 510 breaks the film of surface tension and sanitising material flows into the cistern because of the hydrostatic pressure at the opening 510. Flow of material from the container reduces the pressure within the container until the pressure at the opening 510 of the container 5 equalises with the pressure that the water in the cistern exerts on the opening 510. At this stage, the flow of material from the container ceases except for negligible quantities that escape by diffusion.

When the sanitation system is next used, the water in the cistern, which has now mixed with a small quantity of the sanitising material, flushes into the toilet to clean, disinfect and/or deodorise. Meanwhile, the opening 510 of the container 5 has become exposed and a small quantity of air is drawn into the container 5 to bring the pressure in the air at the top of the container to atmospheric pressure. A film of surface tension then forms across the opening to prevent further drainage of sanitising material from the container 5 until the cistern re-fills and water again contacts the opening 510. At this point another quantity of material is dispensed into the cistern until the pressure reduction in the container 5 again stems the flow. The process then repeats with each subsequent use of the sanitation system.

The quantity of sanitation material dispensed by the apparatus may be determined by the physical dimensions of the opening 510, for example, the length of the outlet passage 520,530 and/or cross-sectional area of the opening 510. Thus, the amount dispensed from the container may be controlled or altered with the use of different outlet openings.

Alternatively, the dispenser may be provided with means for altering the physical dimensions of the opening 510. In the present embodiment, this alteration means may be in the form of an opening 510 formed as a passage 520,530 within a cap 51. The cap 51 includes two nested cap portions 52, 53. The cap portions 52, 53 may be used singly or in combination, such that the length of the passage may be adjusted. In other embodiments, cap portions may be provided with different diameters (not shown), so that the desired diameter may be obtained by selecting the appropriate cap portion. The length and diameter of the opening 510 of the container 5 will influence the flow rate of the liquid or material through the opening. Therefore, the dimensions of the opening may be altered to control the amount of sanitation material that exits the container. The means for altering said physical dimensions of the opening 510 is not limited to the above examples. Any number of embodiments may be proposed to achieve the function of altering the dimensions and constricting the opening of the opening. For example, in a different embodiment, an opening in the form of a hole (not shown) may be provided, the diameter of which may be enlarged by forcing an awl through the hole.

More than one opening may be used, provided that the combined effect of the plurality of openings still ensures that the sanitation material remains substantially in the container once an equilibrium state is reached when the sanitation system is not in use. The provision of a plurality of openings is to allow a greater throughput of sanitation material from the container.

An advantage of the present embodiment is that a simple dispensing container may be placed in a sanitation system. Quantities of sanitation material may be dispensed simply through contact with the liquid that flows through the sanitation system. Conceivably, such an apparatus may conveniently be positioned in a range of points in the sanitation system where contact with liquid is possible.

Figure 3:
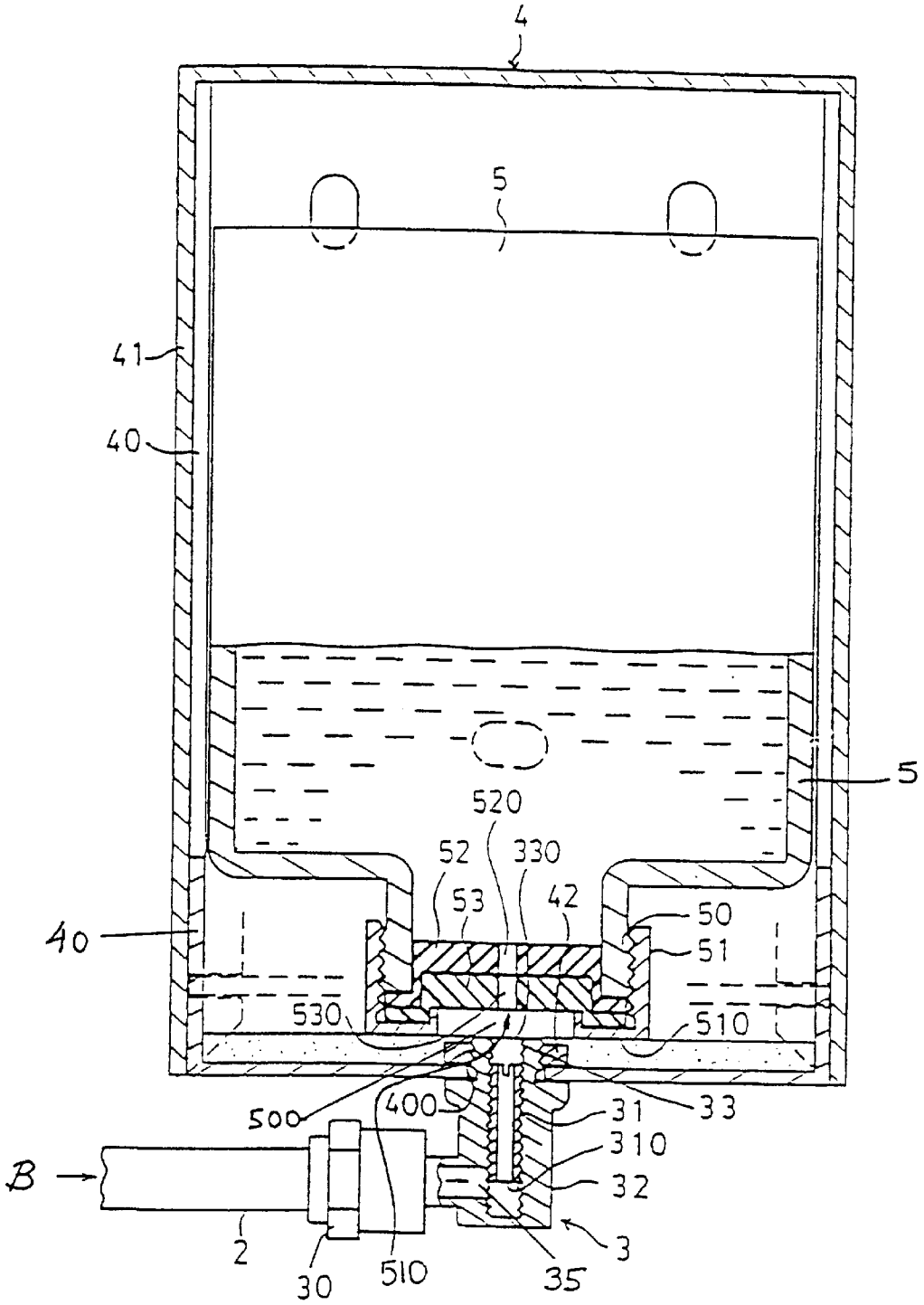
FIG. 3 is a cross-sectional diagram of a sanitation liquid dispensing apparatus constructed according to another embodiment of the invention. (For the sake of clarity, the drawings of the containers shown in FIGS. 1, 3, 3A and 3B are similar and use the same reference number for similar features, however, this does not imply that the embodiments are identical)
Figure 4:
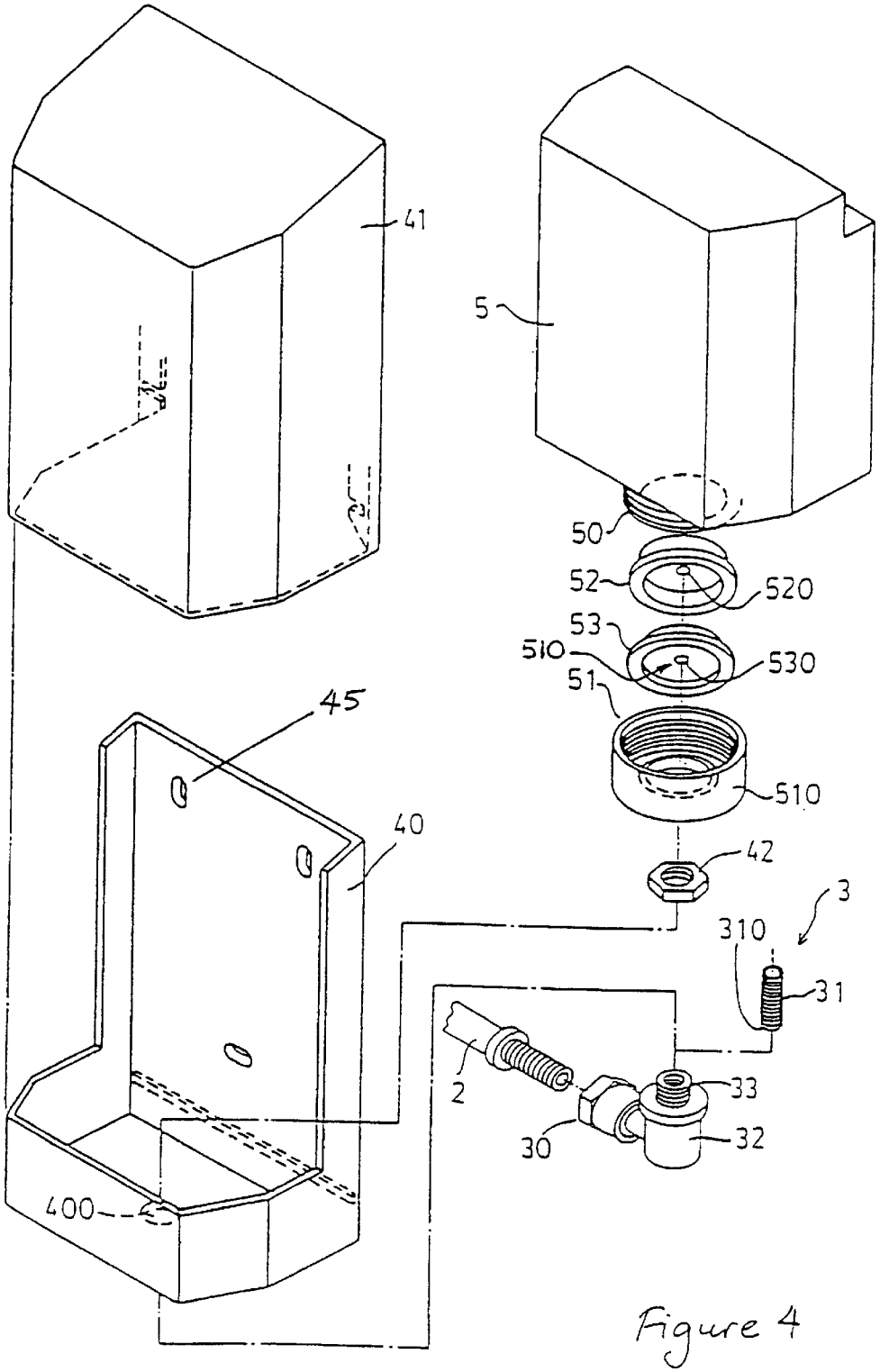
FIG. 4 is a schematic diagram which shows various components of the sanitation liquid dispensing apparatus of FIG. 3.

Another preferred embodiment of the invention is illustrated in FIGS. 3 and 4. In the description of this further embodiment, the drawings of the containers in FIGS. 1 and 3 are similar and use the same reference numbers for similar features for the sake of clarity. This does not imply that the two embodiments are identical.

Referring to FIG. 3, a container 5 is housed in a cabinet 40,41. The container 5 is used to contain flowable sanitation material. The container 5 is also provided with a downwardly directed opening 510. The same principle of extracting sanitation material from the container using a pressure differential effect, described in the above embodiments of FIGS. 1 and 2, is also used in this further embodiment of FIG. 3.

In the preferred embodiment of FIG. 3, fluid from the sanitation system is diverted through the flow passage B to flow immediately adjacent the opening 510 of the container 5. The flow passage of the embodiment is described as follows: fluid enters the cabinet 40,41 through a pipe 2. The pipe 2 is connected to the cabinet 40,41 by an adjustable control valve 3 in the form of an angled screw valve. Fluid from the pipe 2 enters the cabinet in a space 500 which is adjacent the opening 510. The angled screw valve 3 is fitted through a hole 400 in the base of the cabinet 40, and is fastened by a hexagonal nut 42. Although the pipe 2 is connected to the cabinet 40,41 adjacent the opening 520, it is not a requirement of the invention that the fluid enter the cabinet directly under the opening 510. It is sufficient if the fluid contacts the opening 510. However, the fluid should not generally flow into the container 5 directly, since this would lead to a progressive dilution of the sanitation material in the container 5.

It is believed that when the sanitation system is in use, fluid is diverted through the pipe 2 into the space 500 and breaks the film of surface tension across the opening 510 to initiate the flow of sanitising material from the container 5. Fluid and dispensed sanitising material mix and collect in the base of the cabinet 40,41. Once the inflow of fluid from the sanitation system has ceased, the mixture of fluid and sanitising material drain from the cabinet 40,41 to the toilet. This leaves the opening 510 again exposed to air such that the film of surface tension may re-form to stop the flow of sanitary material from the container 5 until the sanitation system is next used.

The fluid from the sanitation system is generally a turbulent mix of air and/or liquid. If the main pipe 610 pressure is high, the diverted fluid may enter the cabinet 40,41 with such force that liquid spills from the dispenser. This may be prevented with the adjustable control valve 3 whereby the flow passage is constricted to further stem the flow into the cabinet 40,41. However, this may also unduly constrict the flow of the sanitising material from the cabinet. In light of this the embodiment shown in FIGS. 3A and 3B has positioned one or more slideable elements such as a plastic sphere 501, in the flow passage B. The sphere 501 fits within the passage B such that the passage is substantially blocked while enough clearance is left to allow the sphere 501 to slide freely.

Figure 3A:
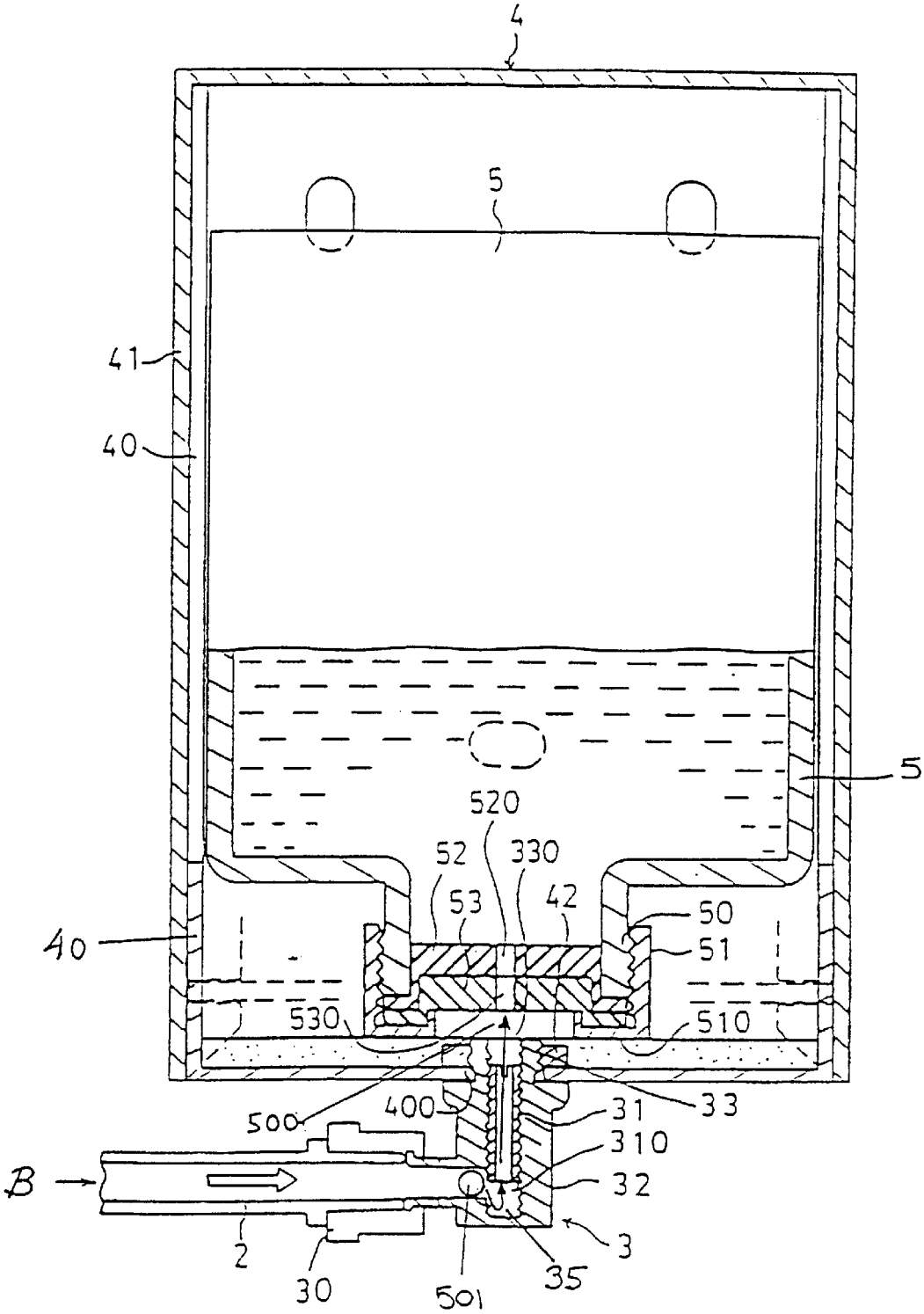
FIGS. 3A and 3B illustrate another embodiment of the invention.

When the sanitation system is flushed, diverted fluid from the main pipe 610 flows rapidly along passage B pushing the sphere 501 before it. This in turn creates a piston of air which is forced along passage B and up into the cabinet 40,41. This creates a flow condition at the opening 510 of the container 5 which serves to break the surface tension film and initiate the flow of sanitary material. The flow condition may be solely air, or air and a small amount of liquid, as most, if not all of the liquid from the sanitation system is prevented from flowing to the cabinet 40,41 when the sphere lodges at the end of passage B as shown in FIG. 3A. Consequently, spillage of liquid from the cabinet 40,41 is avoided.

Figure 3B:
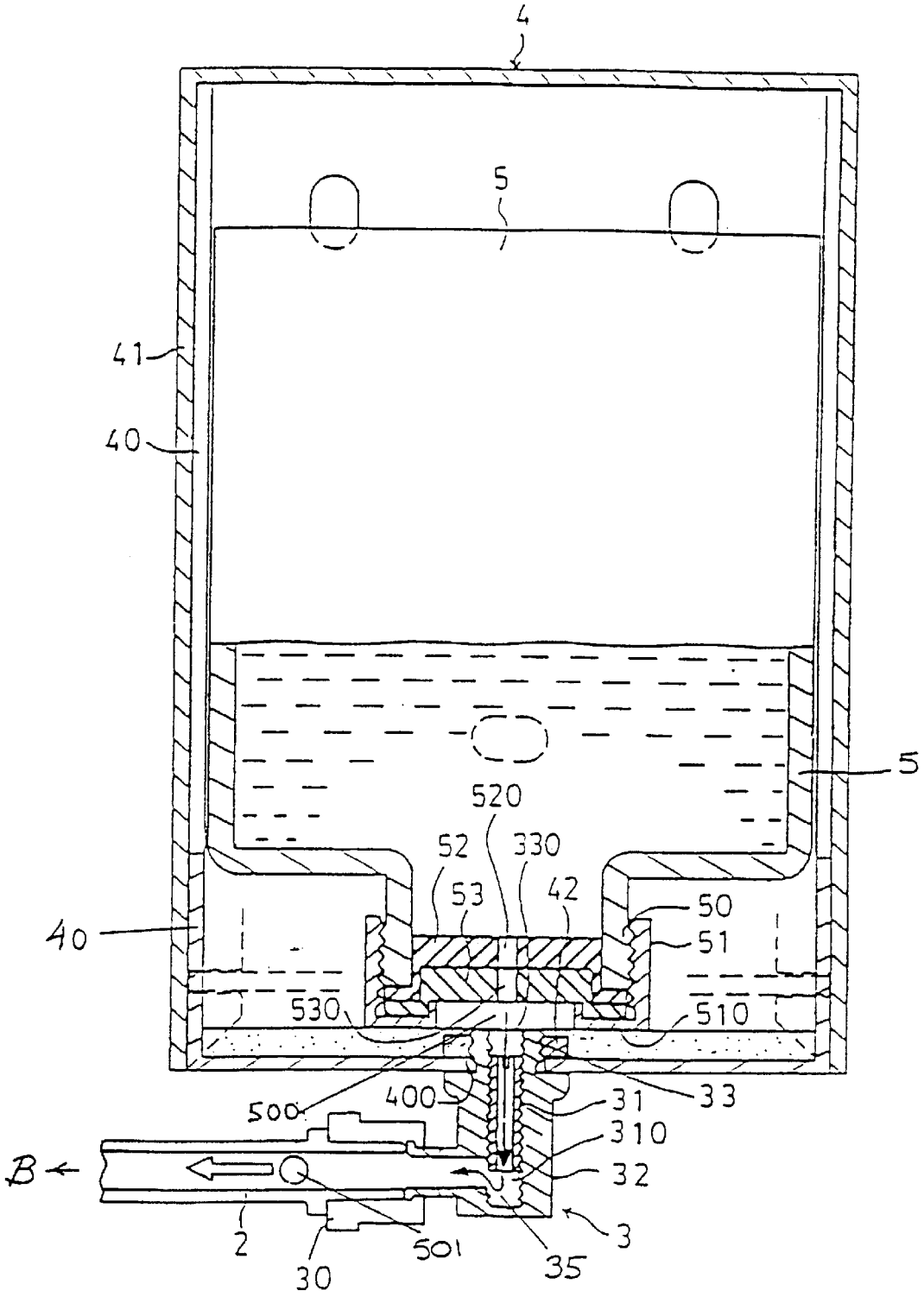

Furthermore, as the fluid drains back into the sanitary system, the sphere 501 will tend to be drawn along with it as shown in FIG. 3B. This creates a region of low pressure between the sphere 501 and the cabinet 40,41 which assists the discharge of the sanitary material through the adjustable control valve 3 into the passage B where it mixes with the liquid as it drains into the sanitary system.

Figure 5:
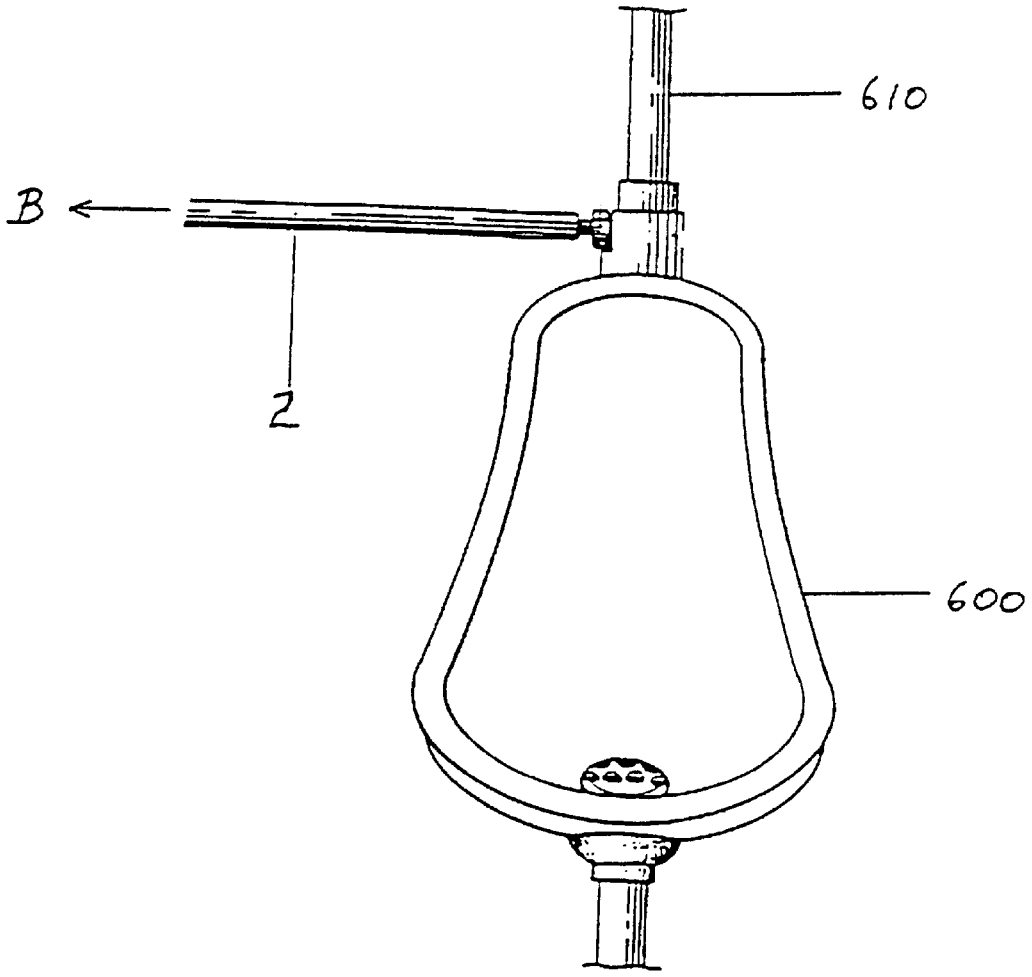
FIG. 5 illustrates an example of a sanitation system to which embodiments of the invention such as the apparatus of FIG. 3, may be attachable.

FIG. 5 illustrates an example of a sanitation system, in the form of a urinal 600, to which embodiments of the present invention may be connected. Water from the mains pipe 610 flows into the urinal during a flushing process. A portion of the water from the mains pipe is diverted along pipe 2 in the direction B. The flow of water in direction B is illustrated in FIG. 3 to show the interrelationship of the components. The urinal in FIG. 5 has been provided as an illustration only. It is clear that embodiments of the invention may also be connectable to other types of sanitation systems such as wash basins, toilet bowls and the like.

In another illustration of this further embodiment, FIG. 4 is a perspective exposed diagram which illustrates the various components shown in FIG. 3. As best seen in FIG. 4, the container 5 is housed inside a two piece cabinet 40,41 comprising a base 40 and a slideable cover 41. The container 5 is removably positioned within base 40, and cover 41 slides onto the base 40 to enclose the container therein. The rear backing plate of the base 40 is provided with holes 45 to allow the cabinet to be mounted, for example, on a wall. In this embodiment, there is no airtight seal, and the interior of the cabinet 40,41 may be open to atmospheric air pressure.

Since the interior of the cabinet 40,41 is provided with vents in the form of ventilation holes 45 and is open to the atmosphere, the scent of the sanitation material within the cabinet is able to diffuse into the atmosphere to provide a pleasant air freshening effect.

The final proportion of sanitation material in the water that eventually leaves the dispensing apparatus to flush the sanitation system is believed to depend on two factors, namely, the amount of water or fluid entering the dispensing apparatus through the pipe 2 and on the quantity of sanitation material that is dispensed into this amount of water.

In the present embodiment, the amount of water or fluid entering the dispensing apparatus is preferably controlled by the valve 3 which has an aperture varying mechanism. The valve 3 consists of an internal duct through which water may flow. Water enters the pipe 2 and flows through the valve duct into the base of the cabinet 40. The internal duct of the valve 3 is internally screw threaded with a female thread. A hollow sleeve 31 is provided with a complementary male screw thread. The position of the sleeve 31 within the internal duct is adjustable by rotating the sleeve 31. The bottom 32 of the sleeve 31 may be raised or lowered to increase or decrease a cross-sectional area of an aperture 35 through which the water must flow. Effectively, the cross-section of the duct is alterable by the variable placement of the sleeve 31 within the duct. Construction of the valve 3 occurs by using the sleeve to close off, to varying degrees, a branch portion of the duct. In this embodiment, the branch portion is formed as a perpendicular junction within the valve 3, although the non linear portion may also be curved.

The upper rim of the hollow sleeve is provided with an indentation or slot which enables the sleeve to be rotated by a screw driver. The size of the aperture 35 is varied by altering the position of the bottom 310 of the sleeve 31. The size of the aperture 35 is selected to enable an appropriate amount of liquid to enter the base of the cabinet 40.

The screw-valve 3 is particularly advantageous when used in sanitation systems that have a definite flushing time. The screw valve would not be advantageous for systems where water is running continuously since the screw valve cannot cut the water flow at a predetermined amount. It relies, instead, on the premise that the flow of water is for a finite time, so that varying the aperture affects the amount of water that passes through the valve in the finite flushing period. As an example, the urinal of FIG. 5 would have a flushing time of a few seconds. during this flushing period, a portion of water is diverted along the pipe 2 through the angled screw valve 3. Therefore, adjustment of the hollow sleeve 31 to vary the size of the aperture determines the amount of water that may enter the cabinet during the finite flushing time. The amount of water entering the cabinet determines the degree of dilution of the sanitation material that returns to the urinal.

Experimentation may be required to achieve the right balance of variables, so as to produce the desired dilution of sanitation material in the water in the sanitation system. Some of these variables include: the amount of water entering the cabinet, the amount of sanitation material that is dispensed into the water, the physical dimensions of the opening 510 of the container 5, the viscosity of the sanitation material. Furthermore, the pressure differential at the opening of the container 5 that extracts the sanitation material may also be influenced by the amount of water that is allowed to enter the base 40 by the aperture varying mechanism.

The aperture varying mechanism may use other mechanisms, other than screw threads, to vary the aperture 35. For example, an inner sleeve may be slideably positioned within the internal duct with a friction or press fit. Alternatively, the aperture varying mechanism may use an iris mechanism, similar to that found in apertures of photographic lenses. Hence, a number of alternative embodiments may be proposed to achieve the function of varying the aperture of the valve 3. Specifically, the aperture varying mechanism need not consist of a screw valve, but may include a number of alternative mechanisms that are able to vary the size of the aperture.

It should be noted that embodiments of the valve having an aperture varying mechanism of the present invention may be used in other types of sanitation material dispensing apparatus. For example, embodiments of the valve having an aperture varying mechanism may be used in the apparatus of International Application No. PCT/GB82/00341 (Lotti). (The content of this prior art document is not incorporated into the present specification.) The disadvantage of the float valve found in the Lotti patent application is that there is no unrestricted flow path for water to enter the chamber. The float valve acts as an obstacle to the flow path of the water, and turbulence in the chamber is thereby minimised. In the present embodiment, there is a clear flow channel for water to enter through the pipe 2 and through the valve 3. The clear flow channel increases the likelihood of turbulence in the cabinet. An amount of turbulence may assist in creating currents of fluid past the opening of the container 5 such that the extraction of the sanitary material is enhanced by the Venturi effect which acts to lower the static pressure of the moving fluid immediately outside the opening. Turbulence may also assist in mixing the sanitation material in the water. Furthermore, a float valve used in the prior art is only capable of allowing a predetermined amount of water to enter the chamber, whereas an aperture varying mechanism allows the amount of water entering the cabinet to be altered. It may be desirable to change the amount of water, depending perhaps on the concentration or type of the sanitation material in the container. More concentrated substances may require a greater amount of water to enter the cabinet to provide a greater degree of dilution.

Figure 6:
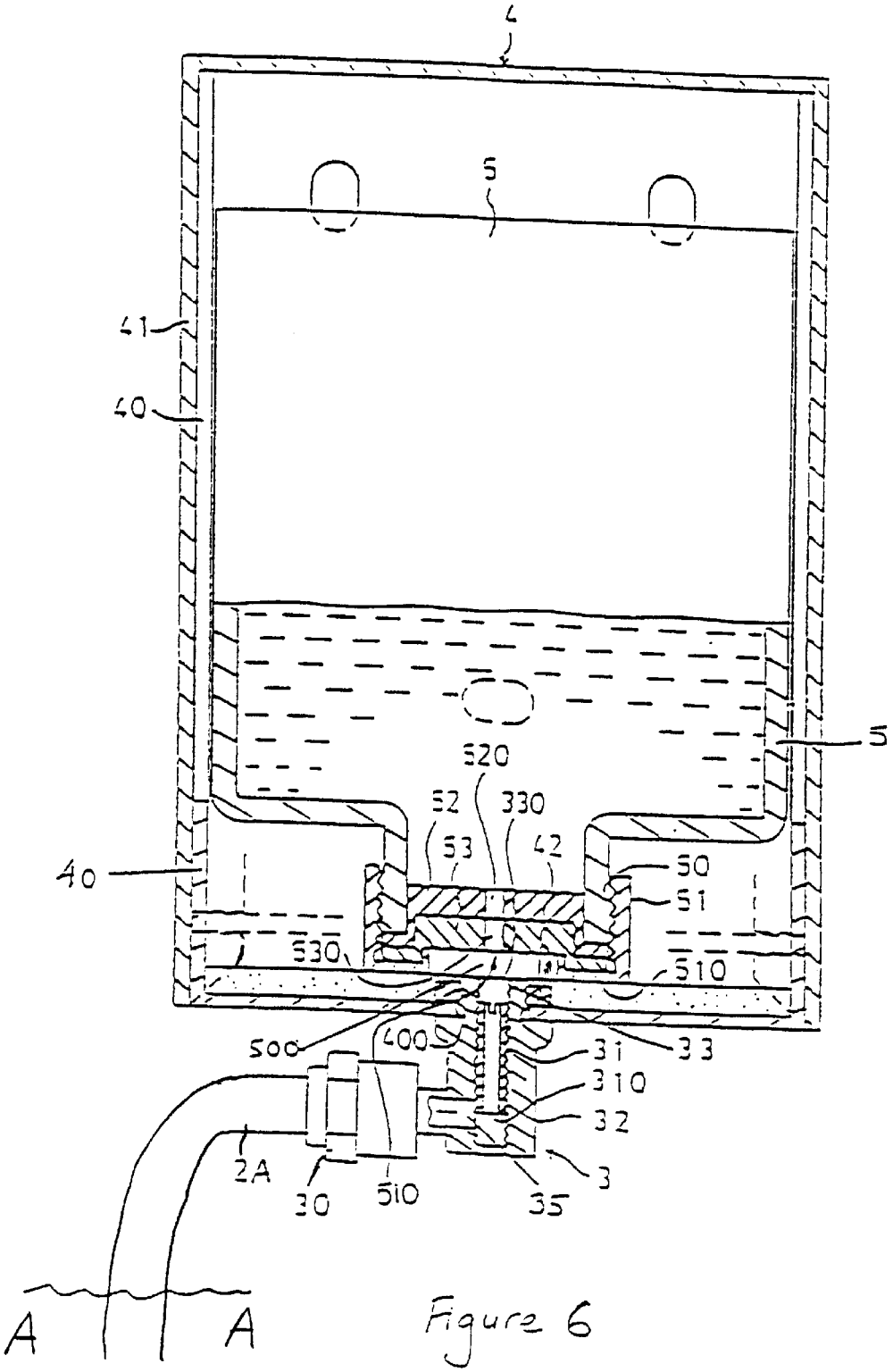
FIG. 6 illustrates a yet further embodiment used in sanitation systems that include a reservoir or holding tank.

A further embodiment of a dispensing apparatus is illustrated in FIG. 6, which is similar to the embodiment of FIG. 3. However, instead of the apparatus 4 being connected to a sanitation system at the mains pipe or other liquid flow channel, the present embodiment is adapted to be used in sanitation systems that include a reservoir or holding tank. The reservoir holds a quantity of liquid that is dispensed with each flush, and the liquid level of this reservoir is illustrated in FIG. 6 as water level A—A.

The apparatus 4 is provided with a depending tube 2A. The tube 2A is able to dip into the liquid in the reservoir A—A. As the liquid level in the cistern or reservoir rises and falls with each flush and refill cycle, the liquid level in tube 2A rises in tandem. Since the liquid level in tube 2A can only rise as high as the liquid level in the cistern, the liquid level in the tube 2A never reaches as high as the valve 3. However, the rise and fall of liquid in tube 2A creates an air flow condition in valve 3. As the liquid level in the tube 2A falls during flushing of the reservoir, air from the cabinet 40,41 flows past the opening 510 of the container, and into the valve 3 and tube 2A to fill the void created by the receding liquid in the tube. This air flow condition is sufficient to draw a small quantity of sanitising material from the container 5 in the manner described above.

In a further embodiment, it may be desired to provide an area of localised low pressure within the cabinet 40,41 adjacent the opening 510. This might be achieved by providing a current of liquid in this vicinity to achieve a Venturi type effect.

In the above embodiments, the components of the cabinet 40,41, the container 5 and the cap 51 may be made of plastics material, and the cap portion 52,53 are preferably made of resilient plastics material. The angled screw valve 3 may be made of injection moulded plastics material, and the hollow sleeve 31 may be made of metal. Importantly, the components of the present invention may be made of any material which serves to fulfil the function of each component.

The liquid that flows through the sanitation system is usually water, but the invention may be useable in sanitation systems that use other types of liquids. The invention in its broadest aspect is not limited to a particular type of liquid.

The embodiments have been advanced by way of example only, and modifications are possible within the spirit and scope of the appended claims.

What is claimed is:

1. A flowable material dispensing apparatus adapted to dispense flowable material, the apparatus including:

a first container having inlet means in order to receive a flow condition directed into the first container, and having outlet means to permit flow of the flowable material out of the first container;

the restricted flow passage having a valve that controls the amount of flow condition flowing between the first and second containers;

wherein the dispensing apparatus is provided with a restricted flow passage operatively adapted to connect the inlet means of the first container to an outside system, the restricted flow passage being restricted to such an extent that the passage is operatively adapted to direct a flow condition into the inlet means of the first container;

the dispensing apparatus having a second container adapted to hold a quantity of said flowable material and having a restricted flow outlet opening facing in a downward direction;

the second container being insertable completely within said first container wherein an inner surface of the first container is separated from a lower external surface of the second container by such that the flow condition flows through the inlet means and flows immediately adjacent the restricted flow outlet opening of the second container;

said restricted flow outlet opening of the second container allowing outflow of the flowable material downwardly through said restricted flow outlet opening generally only when the flowable material in said restricted flow outlet opening is exposed to said flow;

the outlet means of the first container also enabling the flowable material that comes from the second container to exit through the outlet means of the first container.

2. An apparatus of claim 1 wherein the restricted flow passage directing all of said flow condition between the first and second containers;

a flow condition being selected from the group consisting of an air current originating from a sanitation system;

a liquid current originating from the sanitation system; and a current consisting of both air and liquid originating from the sanitation system.

3. The apparatus of 2, wherein the restricted flow passage includes a valve that controls the amount of flow condition flowing between the first and second containers.

4. The apparatus of claim 3, wherein the valve is provided with an internal duct therethrough, said internal duct being alterable in size by an aperture varying mechanism.

5. The apparatus of claim 4, wherein said duct includes a first portion and a second portion angularly connected to the first portion and in fluid communication therewith, said aperture varying mechanism including a hollow sleeve within said first portion, the position of said sleeve being selectively moveable such that fluid communication between the first and second portions is varied depending on the position of the sleeve.

6. The apparatus of claim 2, wherein at least one slideable element is retained within the restricted flow passage and is capable of substantially blocking fluid communication along the flow passage and capable of sliding freely along the flow passage, wherein, in use, the flow condition drives the slideable element along the restricted flow passage such that a flow is forced through the inlet means to create fluid current immediately adjacent the restricted flow outlet opening of the second container.

7. The apparatus of claim 6, wherein, as flow is forced through the inlet means, the at least one slideable element is drawn along the flow passage toward the sanitation system creating a low pressure region between the at least one slideable element and the outlet means to urge flowable material into the restricted flow passage.

8. The apparatus according to claim 6, wherein the at least one slideable element is a plastic sphere.

9. The apparatus of claim 1 wherein the flow condition flows through the inlet means and flows directly onto the restricted flow outlet opening of the second container.

10. The apparatus of claim 1, wherein said inlet means and said outlet means are formed by a single aperture.

11. The apparatus of claim 1, wherein the restricted flow passage is narrower in cross-section than part of a sanitation system that directly connects to the restricted flow passage.

12. The apparatus of claim 1, wherein the quantity of said flowable material extractable from the second container by the flow condition is determined in part by physical dimensions of said restricted flow outlet opening.

13. The apparatus claim 1, wherein said apparatus is provided with means for altering said physical dimensions of said restricted flow outlet opening.

14. The apparatus of claim 1, wherein a localised area of low pressure is formed whereby said flowable material flows from the second container toward the localised low pressure area.

15. The apparatus of claim 1, wherein the flow condition that flows into the first container combines with the flowable material from the second container to be used as a flushing liquid.

16. The apparatus of claim 1, wherein the apparatus further includes mounting means whereby said first container can be mounted in said apparatus with said restricted flow outlet opening being directed in a downward direction in a position to receive said flow condition upwardly against restricted flow outlet opening of the second container.

17. The apparatus of claim 1, wherein the second container is removable from the first container.

18. A method of dispensing a quantity of flowable material into a sanitation system, said method including the steps of:

providing a first container having inlet and outlet means, using a restricted flow passage to connect the inlet means of the first container to the sanitation system in order to receive a flow condition from the sanitation system directed into the first container, and connecting the outlet means of the first container to the sanitation system in order to permit flow of the flowable material out of the first container;

inserting a second container completely within the first container, the second container holding a quantity of said flowable material and having at least one restricted flow outlet opening that faces downwards, wherein an inner surface of the first container is separated from a lower external surface of the second container by a narrow gap immediately adjacent the restricted flow outlet opening of the second container;

directing the flow condition from the sanitation system through the restricted flow passage into the inlet means for the first container;

controlling the flow condition by varying the size of the restricted flow passage;

such that the flow condition from the sanitation system flows through the inlet means into the narrow gap and flows immediately adjacent the restricted flow outlet opening of the second container;

exposing the flowable material in the second container at said restricted flow opening to said flow condition in the narrow gap, thereby releasing the flowable material downwardly through said restricted flow outlet opening into the narrow gap; and releasing the flowable material to exit the narrow gap through the outlet means of the first container into the sanitation system.

19. The method of claim 18 wherein the restricted air flow passage is operatively adapted to direct all of the following flow conditions into the narrow gap between the first and second containers; and said flow conditions comprise:

an air current originating from the sanitation system;

a liquid current originating from the sanitation system; and a current comprising both air current and liquid current originating from the sanitation system.

20. The method of either claim 18 wherein the flow condition from the sanitation system flows into the narrow gag through the inlet means and flows directly onto the restricted flow outlet opening of the second container.

21. The method according to claim 18 further including the step of creating an area of localized low pressure to assist the flow of the flowable material therethrough.

22. The method according to claim 18 wherein the method includes the step of controlling the flow condition that flows immediately adjacent the restricted flow outlet opening of the second container by varying the cross section of the restricted flow passage.

23. A flowable material dispensing apparatus adapted to dispense flowable material, the apparatus including:

a first container having inlet means in order to receive a flow directed into the first container, and having outlet to permit flow of the flowable material out of the first container;

wherein the dispensing apparatus is provided with a restricted flow passage operatively adapted to connect the inlet means of the first container to an outside system, the restricted flow passage being restricted to such an extent that the passage is operatively adapted to direct a flow condition into the inlet means of the first container;

the dispensing apparatus having a second container adapted to hold a quantity of said flowable material and having a restricted flow outlet opening facing in a downward direction;

the restricted flow outlet passage including a valve that controls the flow condition that flows between the first and second containers;

the second container being insertable completely within said first container wherein an inner surface of the first container is separated from a lower external surface of the second container by such that the flow condition flows through the inlet means and flows immediately adjacent the restricted flow outlet opening of the second container;

said restricted flow outlet opening of the second container allowing outflow of the flowable material downwardly through said restricted flow outlet opening generally only when the flowable material in said restricted flow outlet opening is exposed to said flow condition;

the outlet means of the first container also enabling the flowable material that comes from the second container to exit through the outlet means of the first container.

24. A flowable material dispensing apparatus adapted to dispense flowable material, the apparatus including:

a first container having inlet means in order to receive a flow condition directed into the first container, and having outlet means to permit flow of the flowable material out of the first container;

wherein the dispensing apparatus is provided with a restricted flow passage operatively adapted to connect the inlet means of the first container to an outside system, the restricted flow passage being restricted to such an extent that the passage is operatively adapted to direct a flow condition into the inlet means of the first container;

the dispensing apparatus having a second container adapted to hold a quantity of said flowable material and having a restricted flow outlet opening facing in a downward direction;

the restricted flow passage includes a valve that controls the amount of flow condition flowing between the first and second containers;

the second container being insertable completely within said first container wherein an inner surface of the first container is separated from a lower external surface of the second container by such that the flow condition flows through the inlet means and flows immediately adjacent the restricted flow outlet opening of the second container;

said restricted flow outlet opening of the second container allowing outflow of the flowable material downwardly through said restricted flow outlet opening generally only when the flowable material in said restricted flow outlet opening is exposed to said flow condition;

the outlet means of the first container also enabling the flowable material that comes from the second container to exit through the outlet means of the first container.

* * * * *